US008640390B2

(12) United States Patent
Schlueter

(10) Patent No.: US 8,640,390 B2
(45) Date of Patent: Feb. 4, 2014

(54) DECORATIVE STRIP FOR SHOWERS

(75) Inventor: Werner Schlueter, Iserlohn (DE)

(73) Assignee: Schlueter-Systems KG, Iserlohn (DE)

( * ) Notice: Subject to any disclaimer, the term of this patent is extended or adjusted under 35 U.S.C. 154(b) by 0 days.

(21) Appl. No.: 12/930,980

(22) Filed: Jan. 21, 2011

(65) Prior Publication Data

US 2011/0183153 A1 Jul. 28, 2011

(30) Foreign Application Priority Data

Jan. 25, 2010 (DE) ..... 20 2010 001 352 U

(51) Int. Cl.
*E04H 3/00* (2006.01)
*A47K 3/34* (2006.01)

(52) U.S. Cl.
USPC ..... 52/34; 4/600; 4/596; 4/12; 4/613; 4/609; 52/716.2; 52/718.01; 52/287.1

(58) Field of Classification Search
USPC ..... 52/34, 287.1, 288.1, 716.1, 716.2, 52/718.01, 393–395, 402, 459–462, 52/465–466, 470–471, 506.01, 509; 4/596–614, 578, 663
See application file for complete search history.

(56) References Cited

U.S. PATENT DOCUMENTS 3,667,177 A * 6/1972 Biela ..... 52/278
5,159,723 A * 11/1992 Benedict ..... 4/584
5,243,798 A * 9/1993 Elliott ..... 52/273
5,243,799 A * 9/1993 Schluter ..... 52/282.1
5,778,464 A * 7/1998 Chapple et al. ..... 4/596
5,950,370 A * 9/1999 Peck ..... 52/35
5,997,009 A * 12/1999 Geise ..... 277/650
6,115,982 A 9/2000 Lindenberg
6,345,480 B1 * 2/2002 Kemper et al. ..... 52/395
6,401,418 B1 * 6/2002 Senn et al. ..... 52/506.01
6,591,575 B2 * 7/2003 Benedettini ..... 52/716.1

(Continued)

FOREIGN PATENT DOCUMENTS

CH 698 095 5/2009
DE 39 22 927 1/1991
DE 297 11 389 U1 10/1997
DE 203 00 424 U1 10/2003

(Continued)

OTHER PUBLICATIONS

German Search Report dated Nov. 29, 2010 with English translation of the relevant parts.

(Continued)

*Primary Examiner* — Brian Glessner
*Assistant Examiner* — Beth Stephan
(74) *Attorney, Agent, or Firm* — Collard & Roe, P.C.

(57) ABSTRACT

A decorative strip (10; 40; 60; 80; 100; 120; 150; 180; 230; 260; 290) for ceramic, natural stone or synthetic coverings or coatings, in particular for the formation of walk-in showers with a sloped floor, comprising a decorative strip profile (12; 42; 62; 82; 102; 122; 152; 182; 232; 262; 292) having a visible decorative surface (16; 50; 70; 92; 142; 164; 196; 236; 274; 302), characterized in that the decorative strip (10; 40; 60; 80; 100; 120; 150; 180; 230; 260; 290) has a holding profile (14; 44; 64; 84; 104; 124; 154; 184; 234; 264; 294) in which the decorative strip profile (12; 42; 62; 82; 102; 122; 152; 182; 232; 262; 292) is retained height-adjustably so as to vary the height of its visible decorative surface (16; 50; 70; 92; 142; 164; 196; 236; 274; 302).

16 Claims, 13 Drawing Sheets

(56) References Cited

U.S. PATENT DOCUMENTS

| | | | | |
|---|---|---|---|---|
| 6,735,793 | B2 * | 5/2004 | Peterson | 4/613 |
| 6,745,534 | B2 * | 6/2004 | Kornfalt | 52/468 |
| 7,506,480 | B1 * | 3/2009 | Chandler | 52/393 |
| 7,677,004 | B2 * | 3/2010 | LaLonde | 52/506.06 |
| 7,703,249 | B2 * | 4/2010 | Rachak | 52/288.1 |
| 8,181,286 | B2 * | 5/2012 | Cook | 4/613 |
| 2005/0039409 | A1 | 2/2005 | Sondermann | |
| 2005/0050628 | A1 * | 3/2005 | Mascheroni | 4/613 |
| 2005/0076606 | A1 | 4/2005 | Curtis | |
| 2005/0081290 | A1 * | 4/2005 | Stimpson | 4/613 |
| 2005/0177936 | A1 * | 8/2005 | Graells Pane | 4/613 |
| 2006/0213006 | A1 * | 9/2006 | Rush et al. | 4/613 |
| 2006/0260233 | A1 | 11/2006 | Schluter | |
| 2006/0272269 | A1 * | 12/2006 | Bannister | 52/718.01 |

FOREIGN PATENT DOCUMENTS

| | | | |
|---|---|---|---|
| DE | 10 2006 026 707 | A1 * | 12/2007 |
| DE | 10 2006 026 709 | | 2/2008 |
| DE | 20 2007 015 355 | | 3/2008 |
| DE | 20 2007 015 355 | U1 | 4/2008 |
| DE | 10 2007 036 833 | | 2/2009 |
| EP | 0 900 897 | | 3/1999 |
| FR | 1 109 944 | | 2/1956 |
| GB | 1 133 413 | | 11/1968 |
| GB | 2 425 785 | | 11/2006 |

OTHER PUBLICATIONS

European Search Report dated May 4, 2012 in EP 11 15 1386 with English translation of the relevant parts.

* cited by examiner

DECORATIVE STRIP FOR SHOWERS

CROSS REFERENCE TO RELATED APPLICATIONS

Applicant claims priority under 35 U.S.C. §119 of German Application No. 20 2010 001 352.6 filed on Jan. 25, 2010, the disclosure of which is incorporated by reference.

BACKGROUND OF THE INVENTION

1. Field of the Invention

The present invention relates to a decorative strip for ceramic, natural stone or synthetic coverings or coatings, in particular for the formation of walk-in showers with a sloped floor, comprising a decorative strip profile having a visible decorative surface.

2. Description of the Related Art

When producing walk-in showers the floor of the shower is provided with a slope that is inclined towards a floor drain in order to guarantee proper discharge of the shower water. If a so-called line drain is chosen as the floor drain, for example in the form of a drain channel disposed on the wall side and extending parallel to the bathroom wall, due to the slope of the floor in the shower area a wedge-shaped recess is formed in relation to the rest of the bathroom floor which is delimited by wedge-shaped recess walls lying opposite one another and by a rectangular recess wall connecting the latter to one another and which extends along the bathroom wall. It can also be desirable for there to be a small recess on the access side of the shower floor so that shower water does not flow to the adjacent floor area. In this case a further rectangular recess wall is provided on the access side of the show floor. Tiles can be used to cover the recess walls. However, this is very laborious and time-consuming due to the need to cut the tiles, in particular in the region of the wedge-shaped recess side walls. Alternatively, decorative strips developed especially for this purpose can be used which can be fitted easily and quickly.

A decorative strip that can be fixed to the floor in order to cover wedge-shaped recess walls is marketed, for example, by the Iserlohn-based company Blanke GmbH & Co. KG under the product name "Aqua-Keil". The decorative strip is formed in one piece and comprises a decorative strip profile with a visible decorative surface tapering in the manner of a wedge in the direction of the longitudinal extension of the profile. In order to fix the decorative strip to the adjacent subsurface said strip further comprises an attachment arm provided with openings which extends perpendicularly to the visible decorative surface of the decorative strip profile so that overall the decorative strip profile has a T-shaped cross-section with a decorative strip profile projecting to both sides from the attachment arm. However, one problem with this decorative strip is that the gradient of the wedge-like tapering of the visible decorative surface of the decorative strip profile is determined when producing the decorative strip, and can in no way be varied at a later stage. Therefore, the decorative strip can only be used to cover wedge-shaped recess walls with a corresponding gradient. Even small deviations in the gradients are immediately apparent. In order to adapt the decorative strip to different thicknesses of floor coverings and floor covering superstructures said strip is furthermore offered in different embodiments which differ from one another as regards the overall height of the decorative strip profile and the height of the floor covering end edge formed by the decorative strip profile. The production and storage of different embodiments of a decorative strip profile is, however, very cost-intensive, and so it is desirable to keep the number of embodiments as small as possible.

A further decorative strip formed in one piece and that can be fixed to a wall for covering wedge-shaped recess walls is marketed by Blanke GmbH & Co. KG under the product name "Aqua-Keil Wand". This decorative strip also comprises a decorative strip profile with a visible decorative surface that tapers like a wedge in the direction of the longitudinal extension of the profile. A cross-over arm, the width of which is substantially matched to the tile thickness plus a slight addition for the tile adhesive is attached to the decorative surface at right angles. An attachment arm provided with openings is attached in turn at right angles to the cross-over arm, said attachment arm serving to secure the decorative strip in the wall region. Therefore, overall the decorative strip has a substantially Z-shaped cross-section. However, the gradient of the wedge-type tapering of the visible decorative surface of the decorative strip profile is also determined when this decorative strip is produced, and so it can not be varied at all at a later stage. Likewise, the decorative strip is offered in different embodiments in order to match different thicknesses of floor coverings and floor covering superstructures, said embodiments differing from one another as regards the overall height of the decorative strip profile and the width of the cross-over arm, by means of which they already have the disadvantages described in relation to the "Aqua Keil" product.

In order to cover rectangular recess walls a decorative strip formed as one piece is offered by the company Blanke GmbH & Co. KG under the product name "Aqua-Deko". This decorative strip comprises a decorative strip profile that is correspondingly provided with a rectangular visible decorative surface. Clamping arms respectively disposed laterally to the decorative surface and bent towards one another are attached to the upper and lower section of the decorative surface. With these clamping arms the decorative strip is pressed, for example, into a tile adhesive so that the tile adhesive surrounds the clamping arms. Due to the undercuts made, anchoring of the decorative strip takes place in this way when the tile adhesive is in the hardened state. However, with this decorative strip too the height of the visible decorative surface is fixed, and so the decorative strip can not be used flexibly.

A further disadvantage of the previously described "Aqua-Keil", "Aqua-Keil Wand" and "Aqua-Deko" products made by the company Blanke GmbH & Co. KG is that these decorative strips do not enable any height adjustment in the case of a subsurface that lowers over time, resulting in unsightly gaps being able to form beneath the fitted decorative strips. This lowering of the subsurface can occur, for example, if insulating under-layers are fitted in the floor area which compact little by little due to the loads acting upon it.

SUMMARY OF THE INVENTION

Proceeding from this prior art it is an object of the present invention to provide a decorative strip of the type specified at the start with an alternative structure, which can be used flexibly, which is variably adaptable to the respective height situation and the material thickness of the floor covering material, and which enables height adjustment in the case of a subsurface lowering over time.

In order to achieve this object the present invention provides a decorative strip of the type specified at the start wherein the decorative strip has a holding profile in which the decorative strip profile is retained height-adjustably so as to vary the height of its visible decorative surface. In other words, the decorative strip according to the invention comprises a decorative strip profile and a separate holding profile which can be moved relative to one another in order to vary the height of the visible decorative surface of the decorative strip profile. Due to this height-adjustability the decorative strip profile according to the invention can be used very variably and additionally enables height adjustment in the case of a subsurface lowering over time.

The holding profile preferably has a U-shaped cross-section area for retaining the decorative strip profile. The distance between the arms of the U-shaped cross-section area disposed parallel to one another is matched here to the thickness of the decorative strip. The securing of the decorative strip at a desired height level within the retaining groove defined by the U-shaped cross-section area of the holding profile is implemented, for example, by the cavity to be found between the bottom of the groove and the lower side of the decorative strip being filled with silicone, tile adhesive or the like. The decorative strip can also be tilted in relation to the bottom of the groove within the retaining groove, by means of which the gradient of the visible decorative surface edge is changed in relation to the bottom of the groove. In this way further adjustability is produced. The U-shaped cross-section area can be formed like a clamp so that it retains the decorative strip profile with a predetermined pretension and/or it can be provided with an insertion aid for the decorative strip profile.

According to one embodiment of the present invention the decorative surface of the decorative strip profile is rectangular in form so that substantially rectangularly shaped recess walls can be covered with the decorative strip.

According to an alternative embodiment of the present invention the decorative surface of the decorative strip profile tapers like a wedge in the direction of the longitudinal extension of the profile so that recess walls formed like a wedge can be covered with this decorative strip.

The decorative strip profile and/or the holding profile can have an attachment arm provided with openings in order to be able to fix the decorative strip to the floor or to the wall by means of tile adhesive or the like. Here the tile adhesive passes through the openings and clamps to the attachment arm, by means of which a secure connection is achieved.

Alternatively or in addition the decorative strip profile and/or the holding profile can be provided with an adhesion structure, in particular with a grid-, fabric- or fleece-type adhesion structure which is formed such that it forms an adhesive connection with a tile adhesive, grouting material or the like.

According to one embodiment of the present invention the holding profile has an overall substantially F-shaped cross-section. In the region of the arm of the F-shaped cross-section extending laterally to the parallel arms openings can be formed so that this arm serves as an attachment arm.

The decorative strip profile can have an overall substantially I-shaped cross-section. The one main surface of the decorative strip profile can thus define the decorative surface, and the other main surface can be provided with an adhesion structure.

Alternatively, the decorative strip profile can have an overall substantially T-shaped cross-section. The one arm of the T-shaped cross-section can thus define the visible decorative surface, whereas the other arm can be provided with openings or an adhesion structure, and so can form the attachment arm.

Furthermore, the decorative strip can have a third, substantially U-shaped end profile that is retained height-adjustably on the decorative strip profile. In this way further height-adjustability of the decorative strip according to the invention is produced.

According to one embodiment of the present invention the decorative strip profile has an overall substantially L-shaped cross-section. An arm of the L-shaped cross-section can thus define the visible decorative surface, and the other arm can form a tile covering.

According to a further embodiment of the present invention the decorative strip profile has a substantially h-shaped cross-section area, the arms of the substantially h-shaped cross-section area disposed parallel to one another being designed to retain a plate element, in particular to retain a glass or plastic panel which forms, for example, a shower cubicle wall. As an extension of the arm of the substantially h-shaped cross-section area of the decorative strip profile extending laterally to the parallel arms an attachment arm provided with through holes can be attached.

According to a further embodiment of the present invention the decorative strip profile has an overall substantially U-shaped cross-section with two parallel arms and a connection arm connecting the latter and which extends at an angle to the parallel arms which is different from 90° so that in the fitted state the connection arm forms an inclined surface.

Furthermore, a third retaining profile which is substantially L-shaped when considered as a cross-section and provided with an attachment arm having openings, can be provided on which the decorative strip profile is retained height-adjustably. In this way further height-adjustability can also be achieved.

The decorative profile and/or the holding profile and/or the end profile and/or the retaining profile is/are preferably produced as a strand part(s) or by the roll forming method or as a flanged profile(s). Furthermore the decorative profile and/or the holding profile and/or the end profile and/or the retaining profile can be produced from metal, in particular stainless steel and/or from plastic.

BRIEF DESCRIPTION OF THE DRAWINGS

Further features and advantages of the present invention are made clear by means of the following description of different embodiments of the decorative strip according to the invention with reference to the attached drawings. These show as follows.

DETAILED DESCRIPTION OF THE PREFERRED EMBODIMENTS

In the following the same reference numbers identify components and component sections corresponding to one another.

Figure 1:
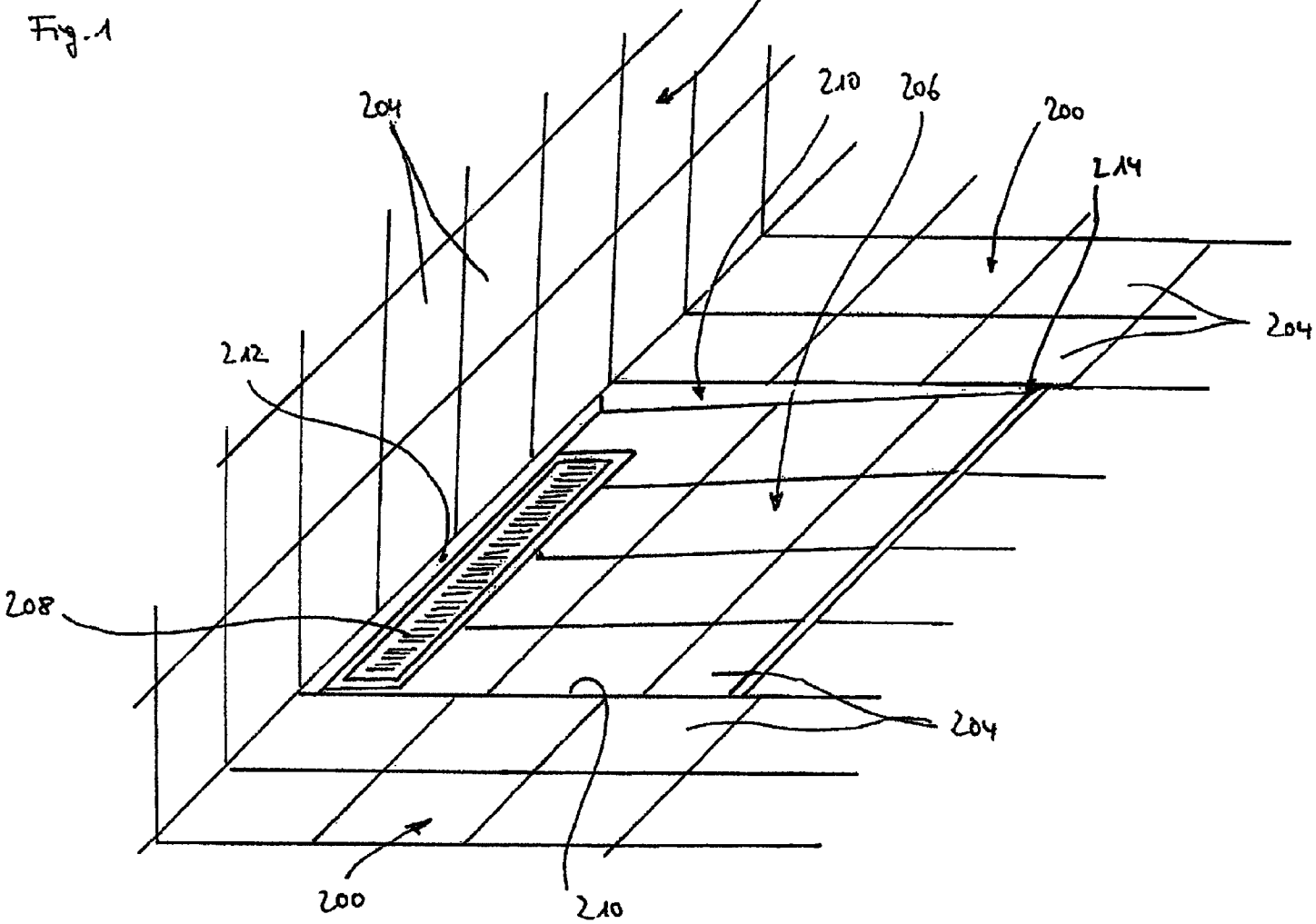
FIG. 1 a diagrammatic perspective view of a bathroom area prepared for the installation of a shower cubicle.

FIG. 1 shows a section of a bathroom with a bathroom floor 200 and a bathroom wall 202 which are respectively covered with tiles 204. In order to fit a walk-in shower a shower floor 206 is prepared in the bathroom floor 200 which is provided with a slope that is inclined towards a floor drain 208 in order to guarantee proper discharge of the shower water. The floor drain 208 is a so-called line drain in the form of a drain channel that is disposed on the wall side and extends parallel to the bathroom wall 202. Due to its slope the shower floor 206 forms in relation to the rest of the bathroom floor 200 a wedge-shaped recess which is defined by wedge-shaped recess walls 210 lying opposite one another and by a rectangular recess wall 212 connecting these to one another. In order to cover these recess walls 210 and 212 the present invention provides a decorative strip. Different embodiments of this decorative strip according to the invention are described in greater detail below with reference to FIGS. 2 to 17.

Figure 2:
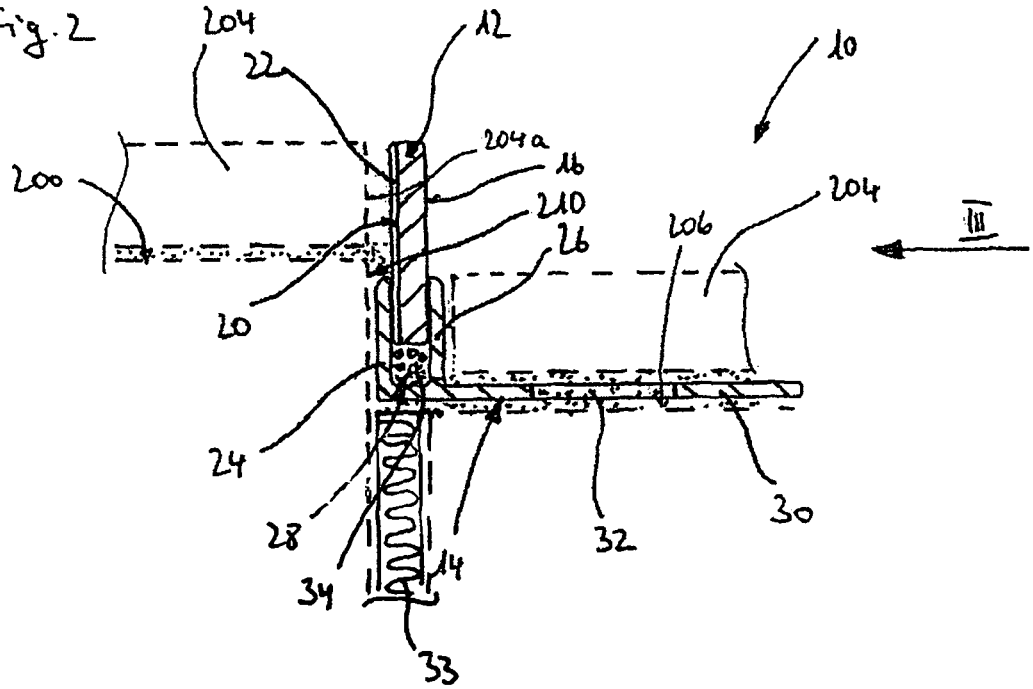
FIG. 2 a cross-sectional view of a decorative strip according to a first embodiment of the present invention.
Figure 3:
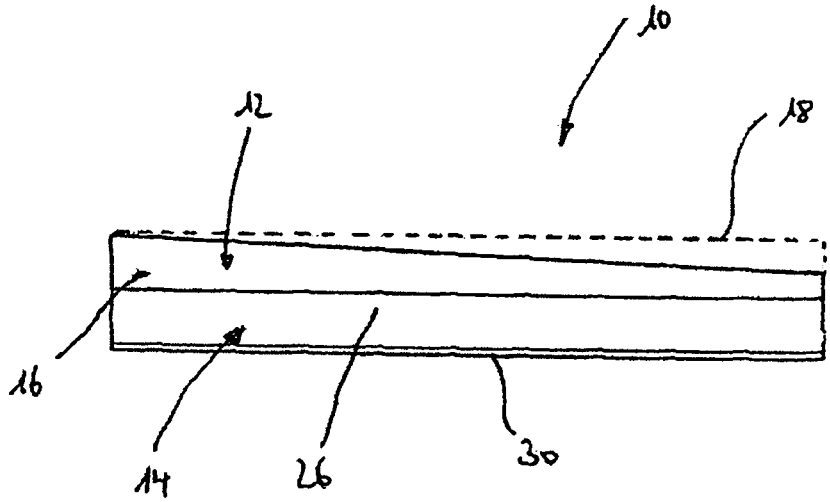
FIG. 3 a side view of the decorative strip shown in FIG. 2 in the direction of arrow III.

FIGS. 2 and 3 show a decorative strip 10 according to a first embodiment of the present invention. The decorative strip 10 comprises a decorative strip profile 12 and a holding profile 14.

The decorative strip profile 12 is an elongate stainless steel strand profile with a rectangular cross-section. It defines a decorative surface 16 which tapers like a wedge in the direction of the longitudinal extension of the profile in order to cover the wedge-shaped recess wall 210 shown in FIG. 1. Alternatively, the decorative surface 16 of the decorative strip profile 12 for covering the rectangular recess wall 212 shown in FIG. 1 can also be rectangular in form, as shown in FIG. 3 by the dashed line 18. The rear-side surface 20 of the decorative strip profile 12 lying opposite the decorative surface 16 is provided with an adhesion structure 22 in the manner of an adhesive strip which can be, for example, a grid-, fabric- or fleece-type adhesion structure which forms an adhesive connection with a tile adhesive or the like.

The holding profile 14 is a strand profile made of metal or plastic with an F-shaped cross-section. The two parallel arms 24 and 26 of the F-shaped cross-section define a retaining groove 28 in which the decorative strip profile 12 is retained height-adjustably. In the exposed area of the arm 30 of the F-shaped cross-section extending laterally to the arms 24 and 26 openings 32 are provided at regular intervals over the whole length of the holding profiles 14 through which adhesive mortar for fixing the holding profile 14 to the subsurface can pass and clamp.

With the embodiment of the shower floor 206 shown in FIG. 1, as shown by dashes in FIG. 2, in a first step the holding profile 14 of the decorative strip 10 is fixed to the shower floor 208 along the recess wall 210 to be covered by means of tile adhesive. The holding profile 14 is then placed over a previously applied insulating strip 33 for noise and/or stress decoupling. Directly afterwards the tiles 204 are laid on the arm 30 of the holding profile 14. After the tile adhesive has hardened the decorative strip profile 12 is inserted into the retaining groove 28 of the holding profile 14, the edges 204*a* facing towards the decorative strip profile 12 of the tiles 204 laid over the bathroom floor 200 adjacent to the shower floor 206 and/or the adhesion structure 22 of the decorative strip profile 12 having previously been provided with an adhesive, for example with tile adhesive or silicone. Due to the height-adjustable retaining of the decorative strip profile 12 in the retainer 28 of the holding profile 14 the upper edge of the decorative strip profile 12 can now be aligned flush with the upper side of the tiles 204. Optionally, the space created between the decorative strip profile 12 and the bottom of the retaining groove 28 of the holding profile 14 can be filled with a filler material 34, such as for example tile adhesive or silicone, in order to provide the decorative strip profile 12 with additional support from below.

By means of the height-adjustable retaining of the decorative strip profile 12 in the holding profile 14 variation of the height of the visible decorative surface 16 is therefore possible. The decorative strip profile 12 can also be tilted within the retaining groove 28 in relation to the bottom of the groove in order to match the gradient of the wedge-shaped decorative strip profile 12 to the actual gradient of the wedge-shaped recess walls 210. Different height movements can also be accommodated between the decorative strip profile 12 and the retaining groove 28.

Figure 4:
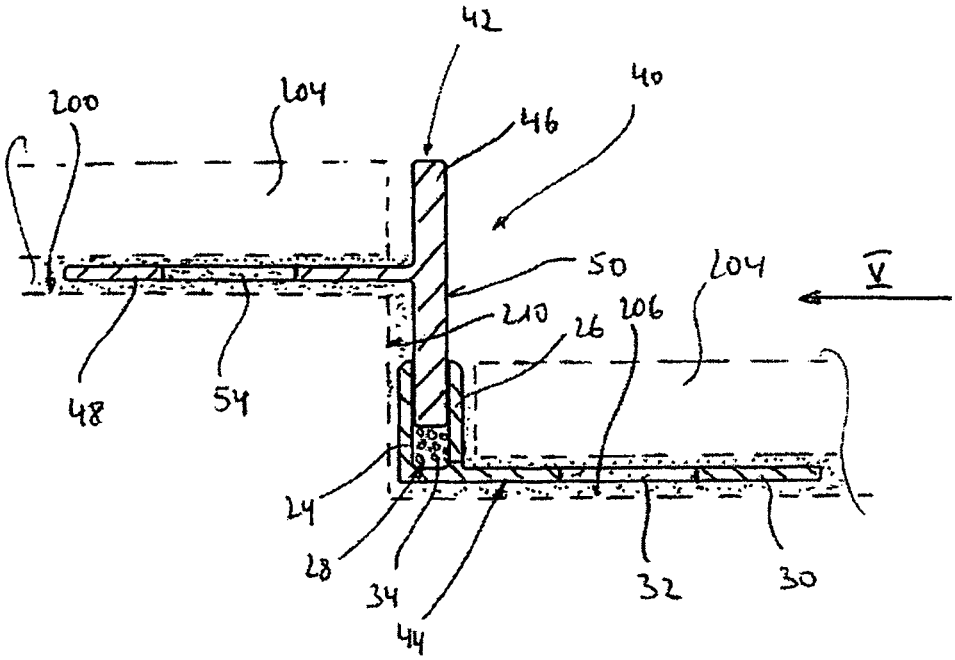
FIG. 4 a cross-sectional view of a decorative strip according to a second embodiment of the present invention.
Figure 5:
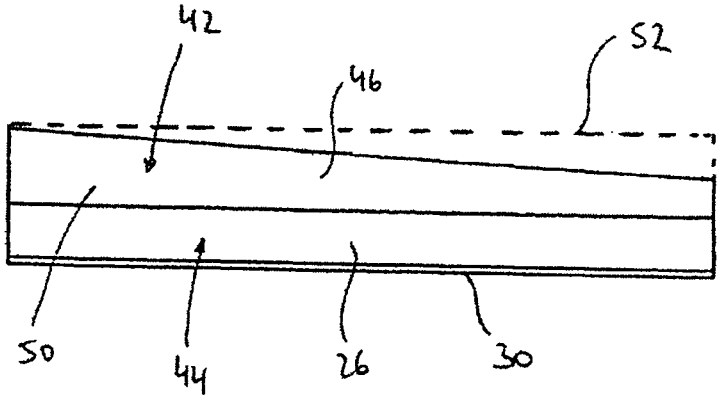
FIG. 5 a side view of the decorative strip shown in FIG. 4 in the direction of arrow V.

FIGS. 4 and 5 show a decorative strip 40 according to a second embodiment of the present invention. The decorative strip 40 comprises a decorative strip profile 42 and a holding profile 44.

The decorative strip profile 42 is an elongate strand profile made of metal or plastic with a T-shaped cross-section formed by two arms 46 and 48 that are disposed perpendicularly to one another. The arm 46 defines a decorative surface 50 that tapers like a wedge in the direction of the longitudinal extension of the decorative strip profile 42 in order to cover the wedge-shaped recess wall 210 shown in FIG. 1. Alternatively, the decorative surface 50 of the decorative strip profile 42 can also be rectangular in form in order to cover the rectangular recess wall 212 shown in FIG. 1, as indicated in FIG. 5 by the dashed line 52. The arm 48 of the decorative strip profile 42 positioned horizontally in FIG. 4 is provided with openings 54 at regular intervals over the whole length of the decorative strip profile 42 through which tile adhesive for fixing the holding profile 14 to the subsurface can pass and clamp. Therefore, the arm 48 forms an attachment arm.

The holding profile 44 is a strand profile made of metal or plastic with an F-shaped cross-section which is formed similarly to the holding profile 14 of the decorative strip 10 according to the first embodiment, and so the holding profile 44 will not be described again below.

With the embodiment of the shower floor 206 shown in FIG. 1, in a first step, as shown by dashes in FIG. 4, the holding profile 44 of the decorative strip 40 is fixed to the shower floor 206 along the recess wall 210 to be covered by means of tile adhesive. For noise and/or stress decoupling the holding profile 44 can also be placed over a previously applied insulating strip, similarly to FIG. 2, even if this is not shown here. Directly afterwards the tiles 204 are then laid on the arm 30 of the holding profile 44. After the tile adhesive has hardened the decorative strip profile 42 is inserted into the retaining groove 28 of the holding profile 44, and the arm 48 of the decorative strip profile 42 extending horizontally in FIG. 4 is stuck onto the bathroom floor 200 by means of tile adhesive. Optionally, the gap created between the decorative strips 42 and the bottom of the retaining groove 28 of the holding profile 44 can be filled with a filler material 34 such as, for example, tile adhesive or silicone, in order to provide the decorative strip profile 42 with additional support from below. The tiles 204 are then stuck onto the arm 48 of the decorative strip profile 42.

Figure 6:
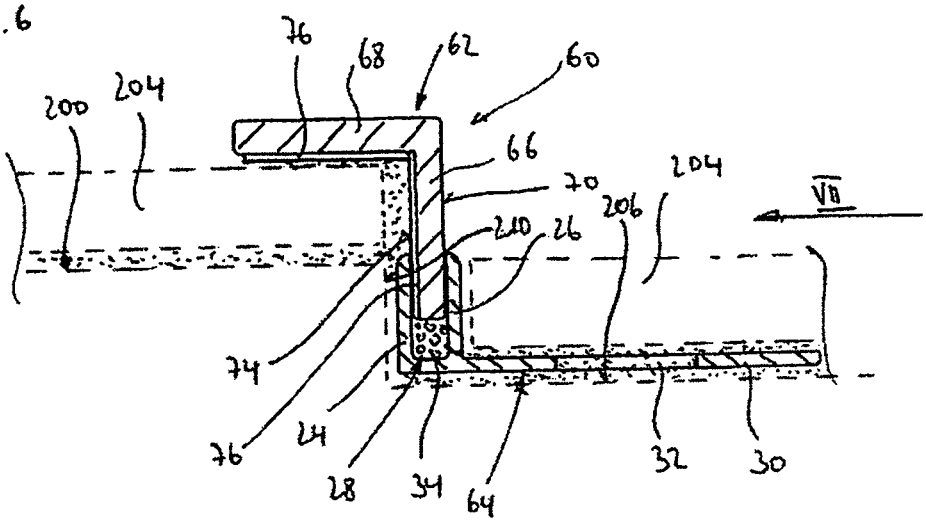
FIG. 6 a decorative strip according to a third embodiment of the present invention.
Figure 7:
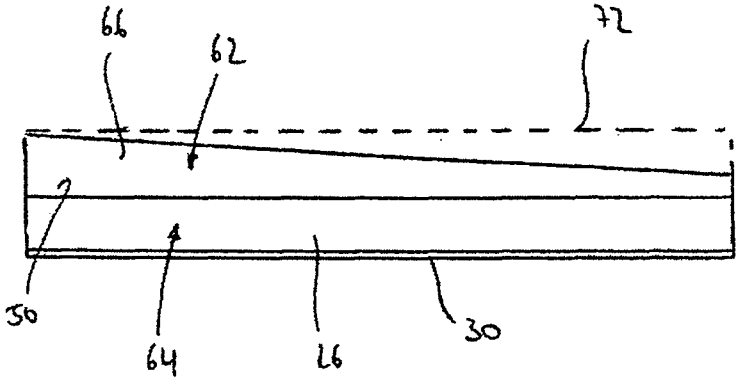
FIG. 7 a side view of the decorative strip shown in FIG. 6 in the direction of arrow VII.

FIGS. 6 and 7 show a decorative strip 60 according to a third embodiment of the present invention. The decorative strip 60 comprises a decorative strip profile 62 and a holding profile 64.

The decorative strip profile 62 is an elongate strand profile made of metal or plastic with an L-shaped cross-section that is made up from two arms 66 and 68 disposed perpendicularly to one another. The arm 66 disposed perpendicularly in FIG. 6 defines a decorative surface 70 which tapers like a wedge in the direction of the longitudinal extension of the profile in order to cover the wedge-shaped recess wall 210 shown in FIG. 1. Alternatively, the decorative surface 70 of the decorative strip profile 62 can also be rectangular in form in order to cover the rectangular recess wall 212 shown in FIG. 1, as indicated in FIG. 7 by the dashed line 72. The rear-side surface 74 of the decorative strip profile 62 lying opposite the decorative surface 70 is provided with an adhesion structure 76 in the manner of an adhesive strip, this possibly being, for example, a grid-, fabric- or fleece-type adhesion structure which forms an adhesive connection with a tile adhesive or the like. The same applies to the lower side of the arm 68 of the decorative strip profile 62 extending horizontally in FIG. 6.

The holding profile 64 corresponds to the holding profile 14 of the decorative strip 10 according to the first embodiment of the present invention, and so the holding profile 64 will not be described again below.

With the embodiment of the shower floor 206 shown in FIG. 1, in a first step, as shown by dashes in FIG. 6, the holding profile 64 of the decorative strip 60 is fixed to the shower floor 206 along the recess wall 210 to be covered by means of tile adhesive. For noise and/or stress decoupling the holding profile 64 can also be placed over a previously applied insulating strip, similarly to FIG. 2, even if this is not shown here. Directly afterwards the tiles 204 are then laid on the arm 30 of the holding profile 64. After the tile adhesive has hardened the decorative strip profile 62 is inserted into the retaining groove 28 of the holding profile 64, the adhesion structures 76 of the decorative strip profile 62 having previously been provided with an adhesive, for example with tile adhesive. Optionally, the space created between the decorative strip profile 62 and the bottom of the retaining groove 28 of the holding profile 64 can be filled with a filler material 34, such as for example tile adhesive or silicone, in order to provide the decorative strip profile 62 with additional support from below. Then the decorative strip profile 62 is pressed into the retaining groove 28 until the lower side of the arm 68 of the decorative strip profile 62 extending horizontally in FIG. 6 comes to rest on the tiles 204 laid over the bathroom floor 200.

Figure 8:
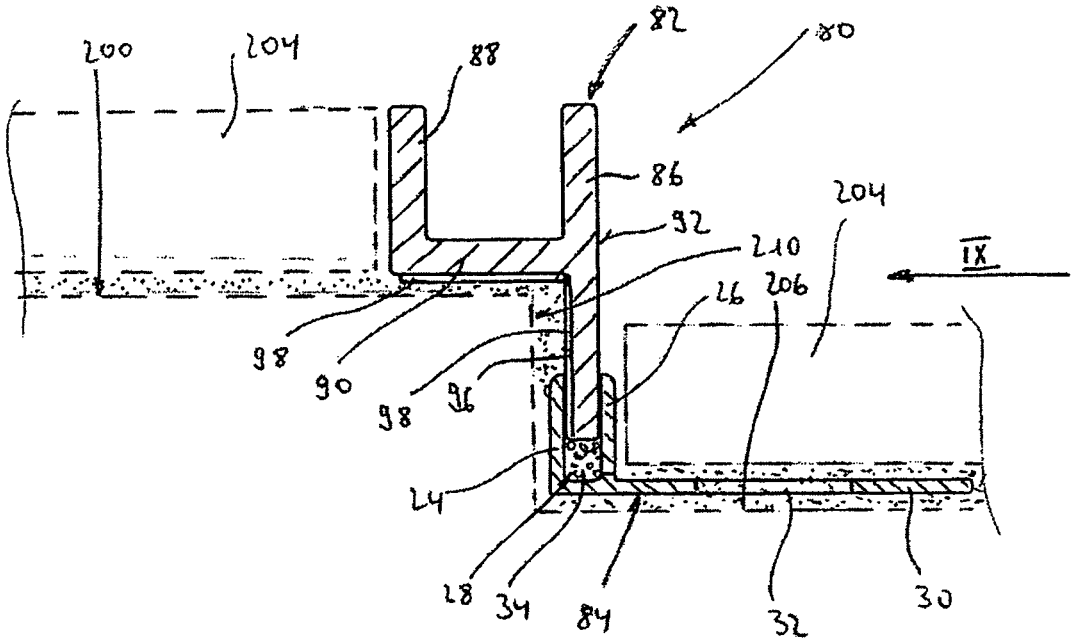
FIG. 8 a cross-sectional view of a decorative strip according to a fourth embodiment of the present invention.
Figure 9:
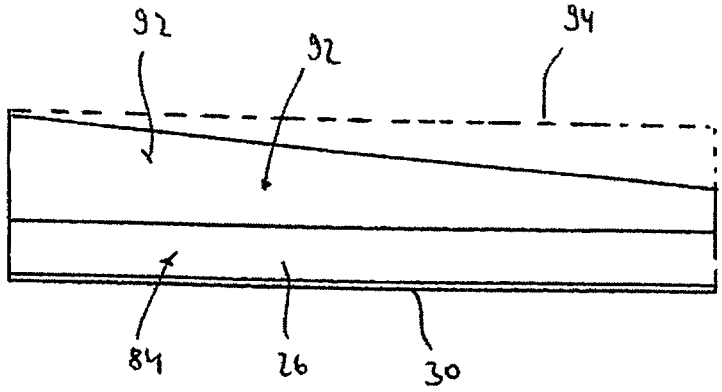
FIG. 9 a side view of the decorative strip shown in FIG. 8 in the direction of the arrow IX.

FIGS. 8 and 9 show a decorative strip 80 according to a fourth embodiment of the present invention. The decorative strip 80 comprises a decorative strip profile 82 and a holding profile 84.

The decorative strip profile 82 is an elongate strand profile made of metal or plastic with an h-shaped cross-section that is formed by two arms 86 and 88 arranged in parallel and an arm 90 extending laterally to the latter. The longer of the two parallel arms 86 defines a decorative surface 92 that tapers like a wedge in the direction of the longitudinal extension of the profile in order to cover the wedge-shaped recess wall 210 shown in FIG. 1. Alternatively, the decorative surface 92 of the decorative strip profile 82 can also be rectangular in form in order to cover the rectangular recess wall 212 shown in FIG. 1, as indicated in FIG. 9 by the dashed line 94. The rear-side surface 96 of the arm 86 lying opposite the decorative surface 92 is provided with an adhesion structure 98 in the manner of an adhesive strip, this possibly being, for example, a grid-, fabric- or fleece-type adhesion structure that forms an adhesive connection with a tile adhesive or the like. The same applies to the lower side of the arm 90 of the decorative strip profile 82 extending horizontally in FIG. 8. The distance between the arms 86 and 88 of the decorative strip profile 82 is chosen such that there can be accommodated between the arms 86 and 88 a partition wall 88, for example a glass or plastic panel, which for example forms a shower cubicle wall.

The holding profile 84 corresponds to the holding profile 14 of the decorative strip 10 according to the first embodiment of the present invention, and so this will not be described again below.

With the embodiment of the shower floor 206 shown in FIG. 1, in a first step, as shown by dashes in FIG. 8, the holding profile 84 on the decorative strip 80 is fixed to the shower floor 206 along the recess wall 210 to be covered by means of tile adhesive. For noise and/or stress decoupling the holding profile 84 can also be placed over a previously applied insulating strip, similarly to FIG. 2, even if this is not shown here. Directly afterwards the tiles 204 are then laid on the arm 30 of the holding profile 84. After the tile adhesive has hardened the decorative strip profile 82 is inserted into the retaining groove 28 of the holding profile 84, the adhesion structures 98 having previously been provided with an adhesive, such as for example with tile adhesive. Optionally, the space created between the decorative strip profile 82 and the bottom of the retaining groove 28 of the holding profile 84 is filled with a filler material 34, such as for example tile adhesive or silicone, in order to provide the decorative strip profile 82 with additional support from below. Then the tiles 204 are laid on the bathroom floor 200 next to the arm 88 of the decorative strip profile 82. A shower cubicle wall, for example, can then be fitted into the retainer defined between the arms 86 and 88 of the decorative strip profile 82.

Figure 10:
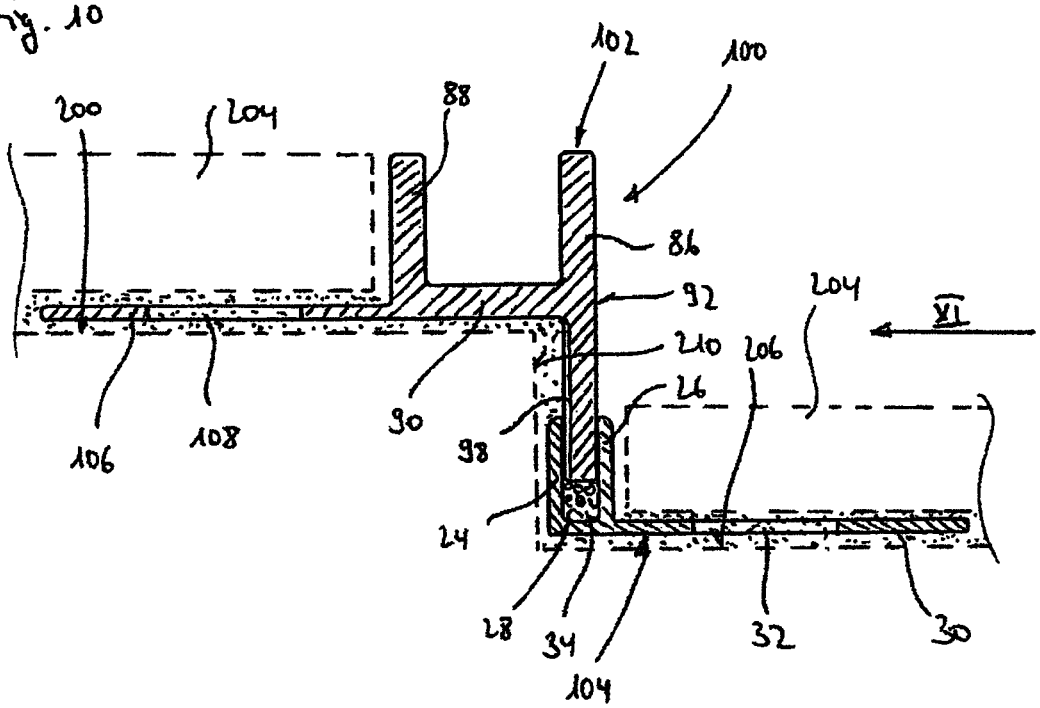
FIG. 10 a cross-sectional view of a decorative strip according to a fifth embodiment of the present invention.
Figure 11:
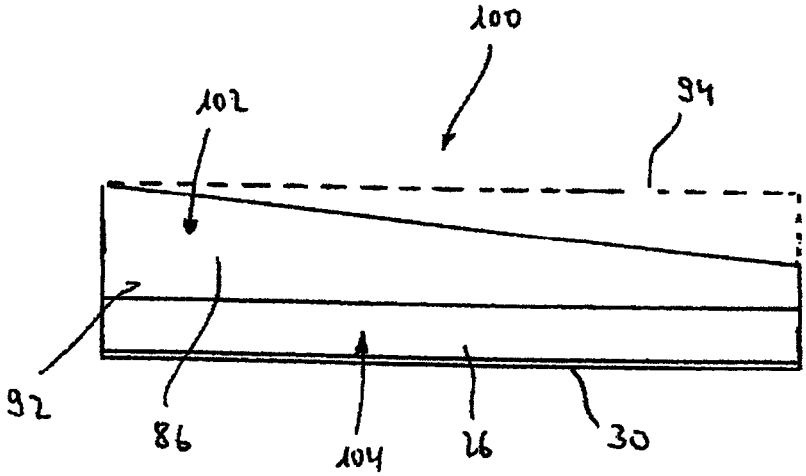
FIG. 11 a side view of the decorative strip shown in FIG. 10 in the direction of arrow XI.

FIGS. 10 and 11 show a decorative strip 100 according to a fifth embodiment of the present invention. The decorative strip 100 comprises a decorative strip profile 102 and a holding profile 104.

The decorative strip profile 102 is an elongate strand profile made of metal or plastic that substantially corresponds to the h-shaped decorative strip profile 82 according to the fourth embodiment of the present invention that was described above with reference to FIGS. 8 and 9. Accordingly, another description of component sections corresponding to one another and which are provided here with the same reference numbers will not be given. One difference between the decorative strip profile 102 and the decorative strip profile 82 is that with the decorative strip profile 102 there is provided over the extension of the arm 90 extending horizontally in FIG. 10 an attachment arm 106 in which openings 108 are formed at regular intervals over the whole length of the decorative strip profile 102. Moreover, in contrast to the arm of the decorative strip profile 82, no adhesion structure is provided on the lower side of the arm 90 of the decorative strip profile 102 because this is made superfluous by the openings 108.

The decorative strip profile 102 corresponds to the decorative strip profile 12 of the decorative strip 10 according to the first embodiment, and so this will not be described again.

With the embodiment of the shower floor 206 shown in FIG. 1, in a first step, as shown by dashes in FIG. 10, the holding profile 104 of the decorative strip 100 is fixed to the shower floor 206 along the recess wall 210 to be covered by means of tile adhesive. For noise and/or stress decoupling the holding profile 104 can also be placed over a previously applied insulating strip, similarly to FIG. 2, even if this is not shown here. Directly afterwards the tiles 204 are then laid on the arm 30 of the holding profile 14. After the tile adhesive has hardened the decorative strip profile 102 is inserted into the retaining groove 28 of the holding profile 104, and the attachment arm 106 of the decorative strip profile 102 is laid on the bathroom floor 200 by means of tile adhesive. Optionally, the space created between the decorative strip profile 102 and the bottom of the retainer of the holding profile 104 can be filled with a filler material 34, such as for example tile adhesive or silicone, in order to provide the decorative strip profile 102 with additional support from below. Directly afterwards the tiles 204 are then laid on the attachment arm 106 along the decorative strip profile 102.

Figure 12:
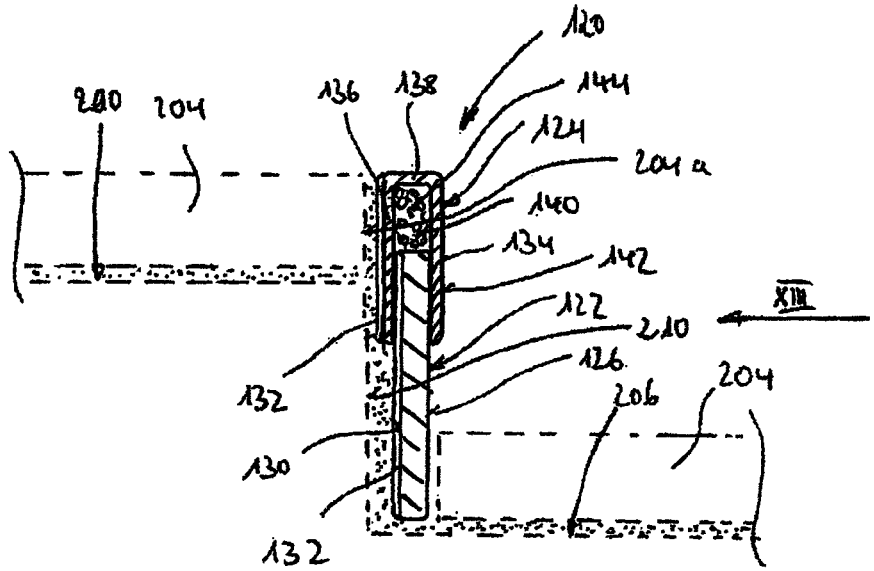
FIG. 12 a cross-sectional view of a decorative strip according to a sixth embodiment of the present invention.
Figure 13:
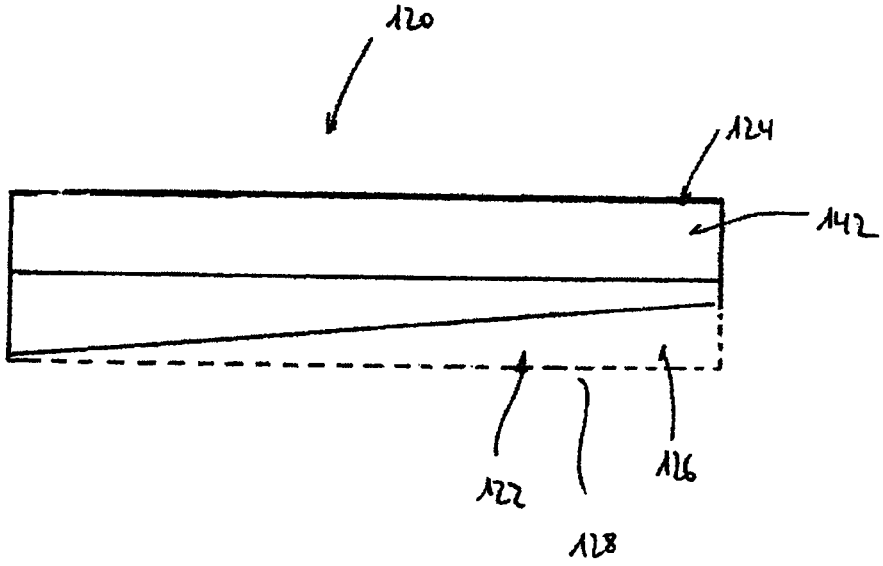
FIG. 13 a side view of the decorative strip shown in FIG. 12 in the direction of arrow XIII.

FIGS. 12 and 13 show a decorative strip 120 according to a sixth embodiment of the present invention. The decorative strip 120 comprises a decorative strip profile 122 and a holding profile 124.

The decorative strip profile 122 is an elongate strand profile made of metal or plastic with a rectangular cross-section. It defines a decorative surface 126 which tapers like a wedge in the direction of the longitudinal extension of the profile in order to cover the wedge-shaped recess wall 210 shown in FIG. 1. Alternatively, the decorative surface 126 of the decorative strip profile 122 can also be rectangular in form in order to cover the rectangular recess wall 212 shown in FIG. 1, as shown by the dashed line 128 in FIG. 13. The rear-side surface 130 of the decorative strip profile 122 lying opposite the decorative surface 126 is provided with an adhesion structure 132 in the manner of an adhesive strip, this possibly being a grid-, fabric- or fleece-type adhesion structure which forms an adhesive connection with a tile adhesive or the like.

The holding profile 124 is a strand profile made of metal or plastic with a U-shaped cross-section which is formed by two parallel arms 134 and 136 and an arm 138 extending laterally to the latter and connecting the arms 134 and 136 to one another. The two parallel arms 134 and 136 define a retaining groove 140 in which the decorative strip profile 122 is retained height-adjustably. The outwardly facing surface of the arm 134 defines a further decorative surface 142. The outwardly facing surface of the arm 136 is also provided with an adhesion structure 132.

In order to form the shower floor 206 shown in FIG. 1, in a first step, as shown by dashes in FIG. 12, the decorative strip profile 122 is inserted into the retaining groove 140 of the holding profile 124, the space remaining between the bottom of the retaining groove 140 and the decorative strip profile 122 possibly being filled with a filler material 144, such as for example silicone, tile adhesive or the like. Then the decorative strip 120 is fixed to the recess wall 210 or to the outwardly facing edge 204*a* of the tiles 204 laid on the bathroom floor 200 using tile adhesive, the upper side of the holding profile 224 being aligned flush to the upper side of the tiles 204. For noise and/or stress decoupling, similarly to FIG. 2, the decorative strip profile 122 can also be placed over a previously applied insulating strip, even if this is not shown here. Then the tiles 204 are laid on the shower floor 206 along the decorative strip profile 122 of the decorative strip 120.

Figure 14:
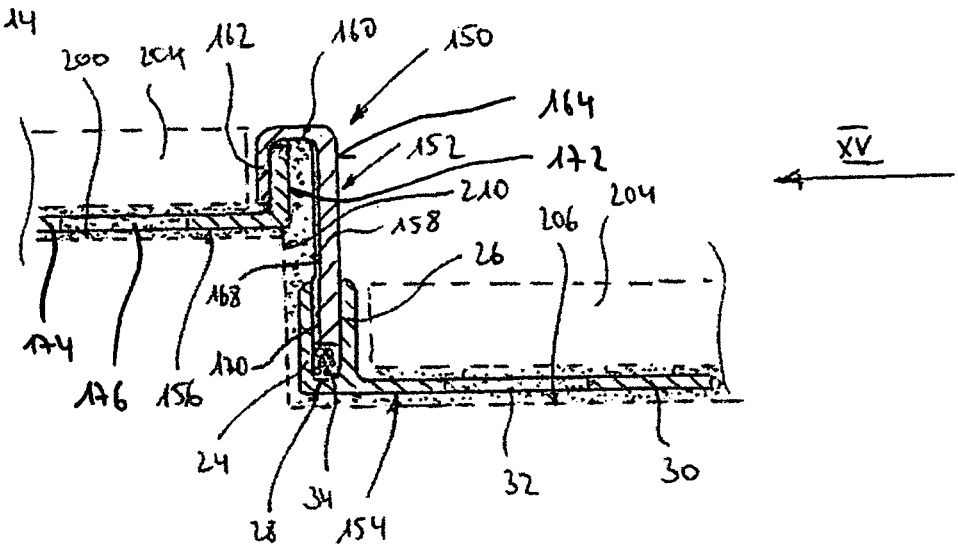
FIG. 14 a cross-sectional view of a decorative strip according to a seventh embodiment of the present invention.
Figure 15:
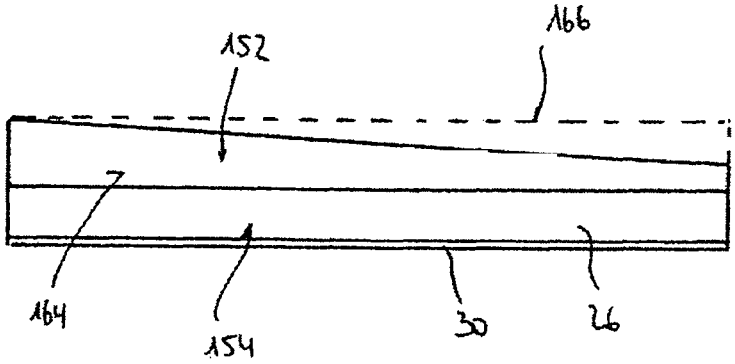
FIG. 15 a side view of the decorative strip shown in FIG. 14 in the direction of arrow XV.

FIGS. 14 and 15 show a decorative strip 150 according to a seventh embodiment of the present invention. The decorative strip 150 comprises a decorative strip profile 152, a holding profile 154 and a retaining profile 156.

The decorative strip profile 152 is an elongate strand profile made of metal or plastic with a J-shaped cross-section that is formed from two parallel arms 158 and 160 and an arm 162 extending laterally to the latter and connecting the arms 158, 160 to one another. Here the arm 158 is longer than the arm 160 disposed parallel to the latter. The outside of the arm 158 defines a decorative surface 164 which tapers like a wedge in the direction of the longitudinal extension of the profile in order to cover the wedge-shaped recess wall 210 shown in FIG. 1. Alternatively, the decorative surface 164 of the decorative strip profile 250 can also be rectangular in form in order to cover the rectangular recess wall 212 shown in FIG. 1, as shown in FIG. 15 by the dashed line 166. The rear-side surface 168 of the arm 158 lying opposite the decorative surface 164 is provided with an adhesion structure 170 in the manner of an adhesive strip, this possibly being a grid-, fabric, or fleece-type adhesion structure which forms an adhesive connection with a tile adhesive or the like.

The holding profile 154 corresponds to the holding profile 14 of the decorative strip 10 according to the first embodiment of the present invention, and so the design of the holding profile 154 will not be discussed again below.

The retaining profile 156 is a strand profile made of metal or plastic with an L-shaped cross-section that is formed by an arm 172 extending vertically in FIG. 14 and an arm 174 disposed at right angles to the latter. The arm 174 is provided with openings 176 arranged at regular intervals over the whole length of the retaining profile 156.

With the embodiment of the shower floor 206 shown in FIG. 1, in a first step, as shown by dashes in FIG. 14, the holding profile 154 of the decorative strip 150 is fixed to the shower floor 206 along the recess wall 210 to be covered by means of tile adhesive. Directly afterwards the tiles 204 are then laid on the arm 30 of the holding profile 254. Next the retaining profile 156 is fixed to the bathroom floor 200 by means of tile adhesive. Then the decorative strip profile 152 is hooked into the perpendicularly extending arm 172 of the retaining profile 156 and inserted into the retaining groove 28 of the holding profile 154. The space to be found between the bottom of the retaining groove 28 of the holding profile 254 and the decorative strip profile 152 can be filled with a filler material, such as for example silicone, tile adhesive or the like. In a further step the tiles 204 are laid along the arm 174 of the retaining profile 156, and the upper side of the decorative strip profile 152 is aligned flush with the upper side of the tiles 204.

Figure 16:
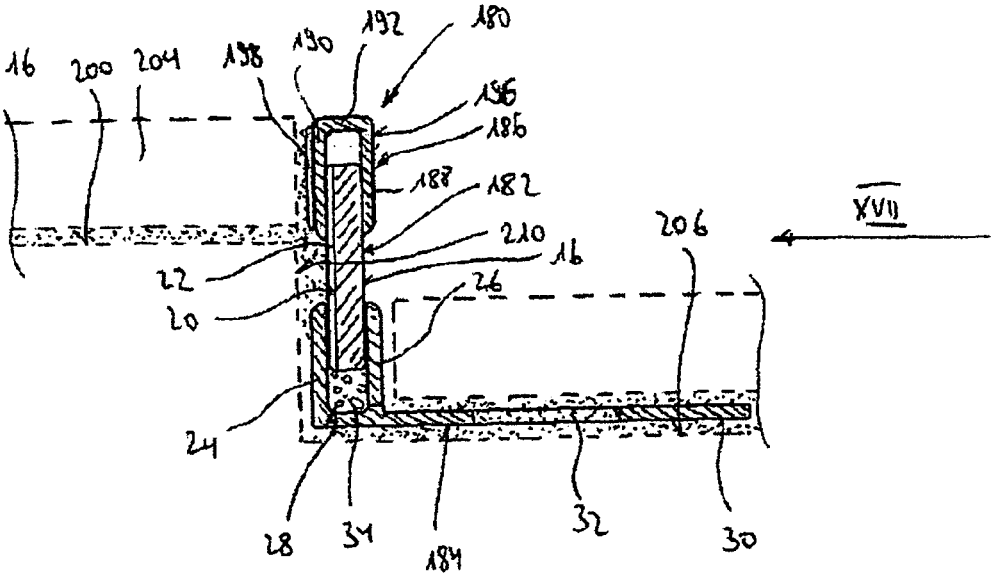
FIG. 16 a cross-sectional view of a decorative strip according to an eighth embodiment of the present invention.
Figure 17:
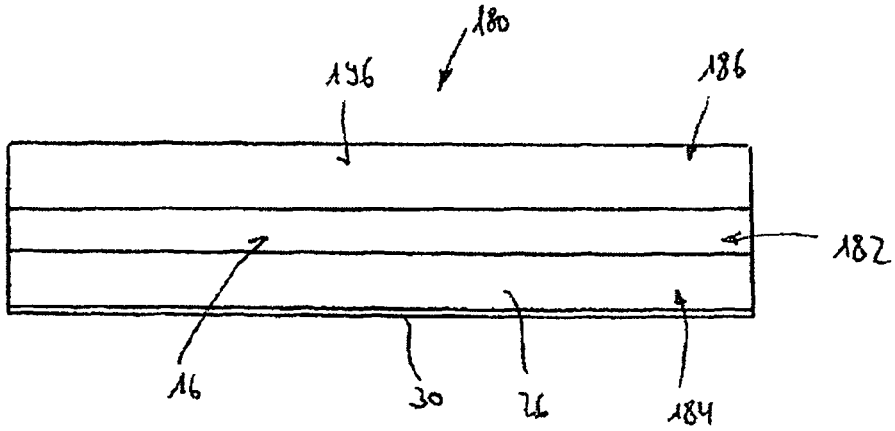
FIG. 17 a side view of the decorative strip shown in FIG. 16 in the direction of arrow XVII.

FIGS. 16 and 17 show a decorative strip 180 according to an eighth embodiment of the present invention. The decorative strip 180 comprises a decorative strip profile 182, a holding profile 184 and an end profile 186. The decorative strip profile 182 and the holding profile 184 correspond respectively to the decorative strip profile 12 and the holding profile 14 of the decorative strip 10 according to the first embodiment of the present invention, and so the latter will not be described again below.

The end profile 186 is an elongate strand profile made of metal or plastic with a U-shaped cross-section which is formed by two parallel arms 188 and 190 and an arm 192 extending perpendicularly to the latter. The outside of the arm 188 forms a further decorative surface 196. The outside of the arm 190 is provided with an adhesion structure 198 in the manner of an adhesive strip which can, for example, be a grid-, fabric- or fleece-type adhesion structure which forms an adhesive connection with a tile adhesive or the like.

With the embodiment of the shower floor 206 shown in FIG. 1, in a first step, as shown by dashes in FIG. 16, the holding profile 184 of the decorative strip 180 is fixed to the shower floor 206 along the recess wall 210 to be covered by means of tile adhesive. Directly afterwards the tiles 204 are then laid on the arm 30 of the holding profile 184. Next the tiles 204 are laid on the bathroom floor 200. In a further step the decorative strip profile 182 is inserted into the retaining groove 28 of the holding profile 184, and then the end profile 186 is placed on the decorative strip profile 182 and stuck by means of tile adhesive to the facing tile edges 204*a* of the tiles 204. By providing both a holding profile 284 and an end profile 186 the possibility of double height-adjustment is offered.

Figure 18:
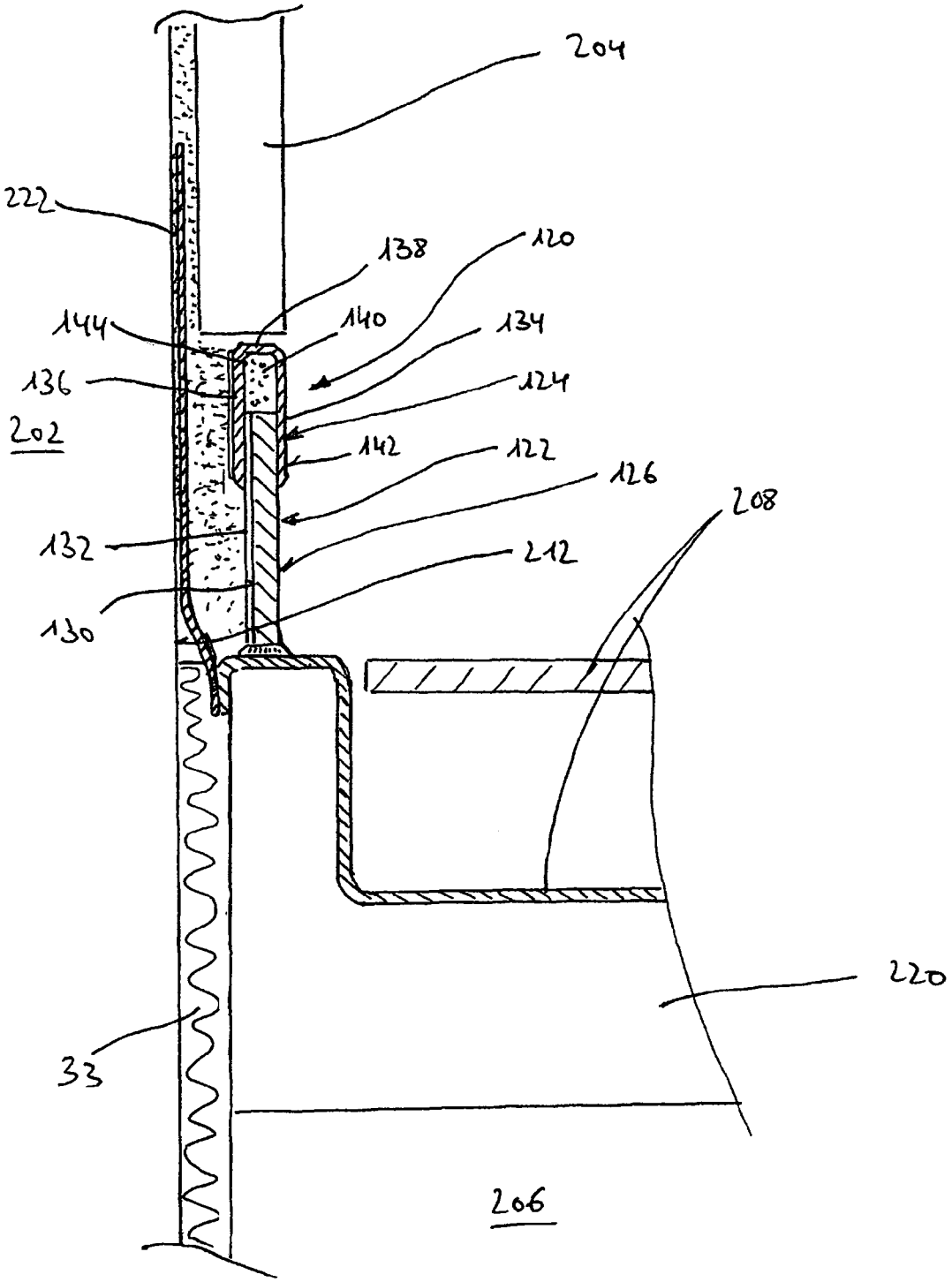
FIG. 18 a cross-sectional view of the decorative strip shown in FIGS. 12 and 13 according to the sixth embodiment of the present invention in a slightly modified form and in an alternative fitting situation in which the decorative strip is disposed adjacent to a floor drain.

FIG. 18 shows the decorative strip 120 already shown in FIGS. 12 and 13 according to the sixth embodiment of the present invention in a slightly modified form and in an alternative fitting situation in which the decorative strip profile 120 covers the recess wall 212 on the bathroom wall side shown in FIG. 1. One modification in comparison to the decorative strip shown in FIGS. 12 and 13 is to the effect that the rear arm 136 of the holding profile 124, considered as a cross-section, is substantially bent like a gable roof and is elastic in form so that the holding profile 124 incorporates the decorative strip profile 122 like a clamp with pretensioning. Furthermore, the free end of the arm 136 is bent away from the decorative strip profile 122, by means of which an insertion aid is produced which facilitates the insertion of the decorative strip profile 122 into the holding profile 124. In a similar way, for example, one of the arms 24 or 26 of an F-shaped holding profile can also be formed like, for example, the F-shaped holding profile shown in FIG. 2.

With the embodiment of the shower floor 206 shown in FIG. 1, in a first step, as shown in FIG. 18, an insulating strip 33 is disposed between the bathroom wall 202 and the shower floor 206. An inclined board 220 accommodating the floor drain 208 is then fixed onto the shower floor 206 such that the inclined board 220 comes to rest against the insulating strip 33. The floor drain 208 is provided on its side facing towards the bathroom wall 202 with a flexible and water-impermeable sealing strip 222 which is directed upwards and is secured with tile adhesive or the like to the bathroom wall 202. The tiles 204 are then stuck onto the bathroom wall 202 at least partially overlapping the sealing strip 222. In order to cover the recess wall 212 the decorative strip 120 is now inserted into the space to be found between the floor drain 208 and the tiles 204 and is on the one hand secured to the sealing strip 222 on the rear side with tile adhesive, and on the other hand to the lower side of the floor drain 208 on the lower side with silicone. A height adjustment of the decorative strip profile 120 can then take place by the decorative strip profile 122 and the holding profile 124 being moved relative to one another. In order to fix a desired height adjustment the space to be found between the decorative strip profile 122 and the holding profile 124 can be filled with a filler material 144 such as, for example, tile adhesive, silicone or the like.

Figure 19:
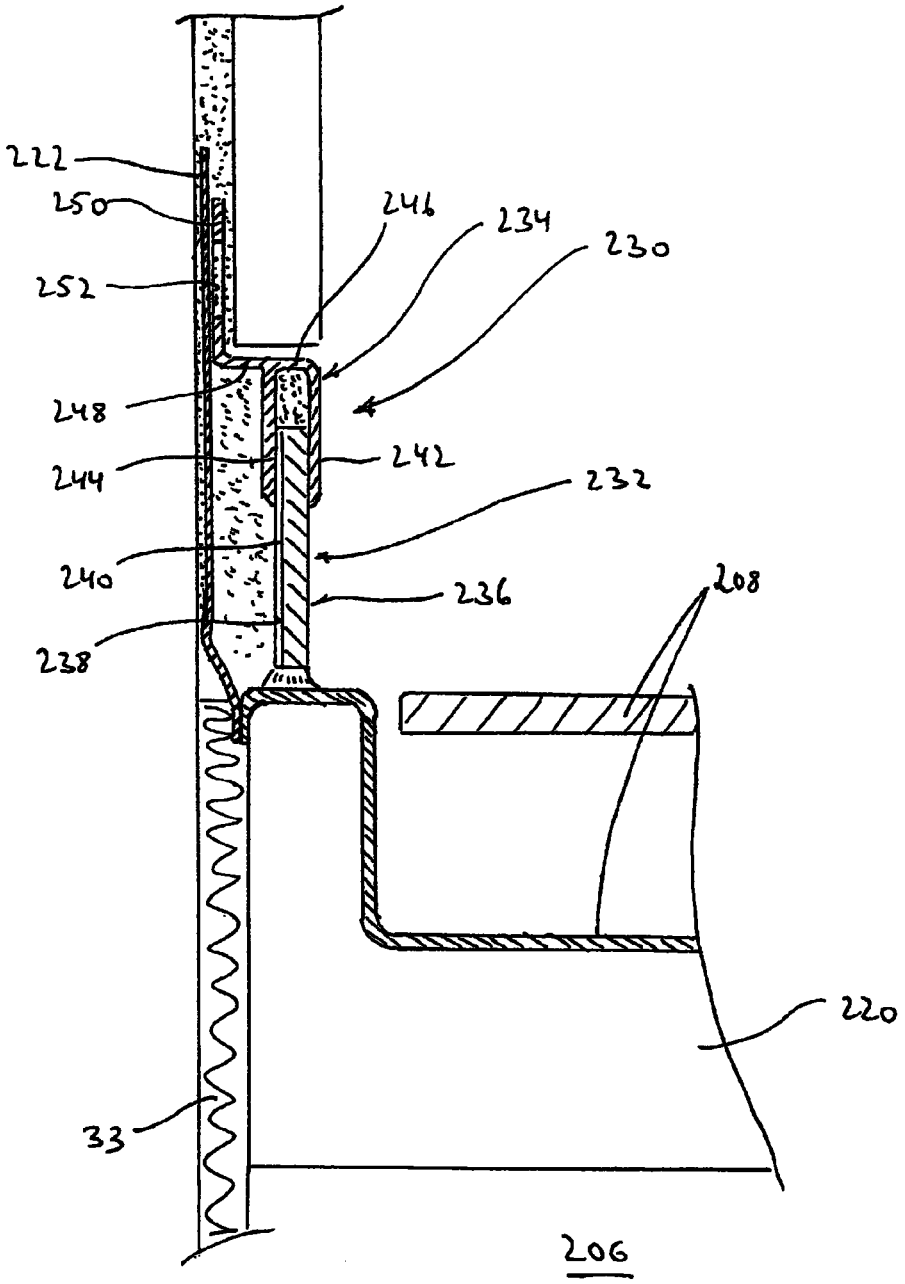
FIG. 19 a cross-sectional view of a decorative strip according to a ninth embodiment of the present invention in the fitted state.

FIG. 19 shows a decorative strip 230 according to a ninth embodiment of the present invention in the fitted state. The decorative strip 230 comprises a decorative strip profile 232 and a holding profile 234.

The decorative strip profile 232 is an elongate strand profile made of metal or plastic with a rectangular cross-section. It defines a decorative surface 236 which also has a rectangular form for covering the recess wall 212 shown in FIG. 1. The rear-side surface 238 of the decorative strip profile 232 lying opposite the decorative surface 236 is provided with an adhesion structure 240 in the manner of an adhesive strip which can be, for example, a grid-, fabric- or fleece-type adhesion structure which forms an adhesive connection with a tile adhesive or the like.

The holding profile 234 is a strand profile made of metal or plastic with a U-shaped cross-section area that is formed from two parallel arms 242 and 244 and an arm 246 extending laterally to the latter and connecting the arms 242 and 244 to one another, and an L-shaped cross-section area which is formed by two arms 248 and 250 disposed perpendicularly to one another, the arm 248 being attached flush to the arm 246 of the U-shaped cross-section area and openings 252 being formed at regular intervals over the whole length of the decorative strip profile 232 in the arm 250.

In order to cover the recess wall 212 shown in FIG. 1 the insulating strip 33, the inclined board 220 with the floor drain 208 held against it and the sealing strip 222 of the floor drain 208 are initially fitted as already described with reference to FIG. 18. The decorative strip 230 is then aligned in relation to its height, and the desired alignment fixed by means of filler material 144. The decorative strip 230 is then fixed on the one hand by means of silicone to the upper side of the floor drain 208, and on the other hand by means of tile adhesive to the sealing strip 222 of the floor drain 208. Next the tiles 204 are stuck to the bathroom wall 202 using tile adhesive, the tiles 204 being aligned to the L-shaped cross-section area of the holding profile 234.

Figure 20:
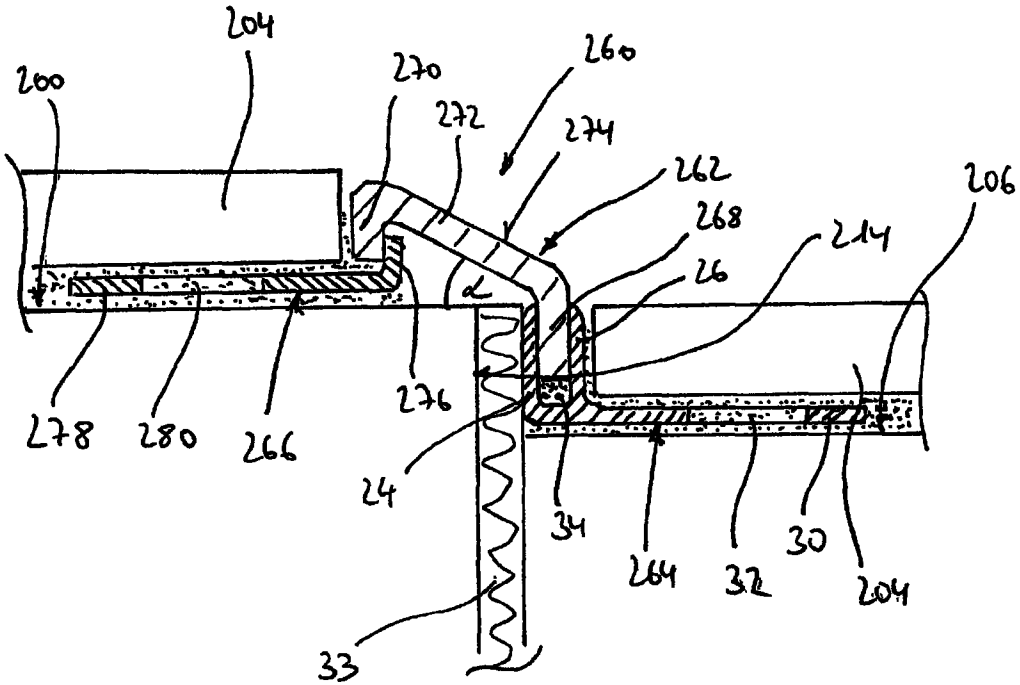
FIG. 20 a cross-sectional view of a decorative strip according to a tenth embodiment of the present invention in the fitted state.

FIG. 20 shows a decorative strip 260 according to a tenth embodiment of the present invention. The decorative strip 260 comprises a decorative strip profile 262, a holding profile 264 and a retaining profile 266.

The decorative strip profile 262 is an elongate strand profile made of metal or plastic with a substantially U-shaped cross-section which is formed from two parallel arms 268 and 270 and a connection arm 272 extending laterally to the latter and connecting the arms 268 and 270 to one another. The connection arm 272 extends at an angle a of approximately 30° to the horizontal so that the angles enclosed between the connection arm 272 and the arms 268 and 270 are different from 90°. Correspondingly, the decorative surface 274 of the decorative strip profile 262 forms in the fitted state an inclined surface, as can be seen in FIG. 20.

The holding profile 264 corresponds to that of the holding profile 14 of the decorative strip 10 according to the first embodiment of the present invention, and so the design of the holding profile 264 will not be discussed again below.

The retaining profile 266 is a strand profile made of metal or plastic with an L-shaped cross-section which is formed by an arm 276 extending vertically in FIG. 20 and an arm 278 disposed at right angles to the latter. The arm 278 is provided with openings 280 arranged at regular intervals over the whole length of the retaining profile 266.

With the shower floor 206 shown in FIG. 1, there is provided on the shower floor access side between the bathroom floor 200 and the shower floor 206 a ledge 214 that prevents shower water from flowing onto the adjacent surface of the bathroom floor 200. In order to cover this ledge 214 with the decorative strip 260, in a first step the holding profile 264 of the decorative strip 260 is fixed to the shower floor 206 along the ledge 214 to be covered by means of tile adhesive. Directly afterwards the tiles 204 are then laid on the arm 30 of the holding profile 264. Next the retaining profile 266 is fixed to the bathroom floor 200 by means of tile adhesive. Then the arm 270 of the decorative strip profile 262 is hooked into the perpendicularly extending arm 276 of the retaining profile 266 and inserted into the retaining groove 28 of the holding profile 264. The space to be found between the bottom of the retaining groove 28 of the holding profile 264 and the arm 268 of the decorative strip profile 262 can be filled with a filler material, such as for example silicone, tile adhesive or the like. In a further step the tiles 204 are laid along the arm 276 of the retaining profile 266.

Figure 21:
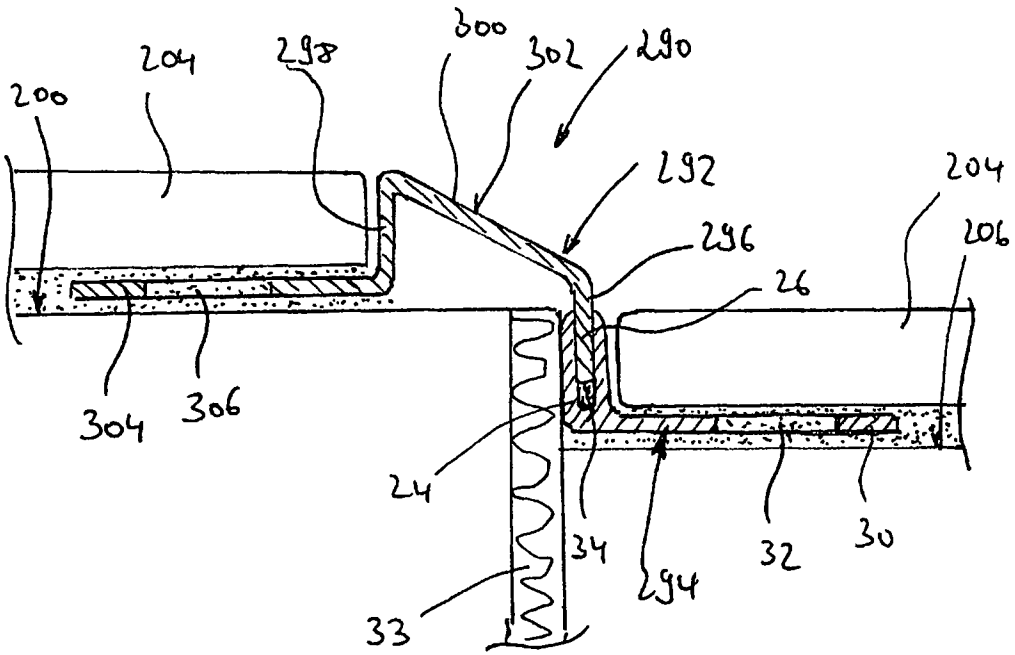
FIG. 21 a cross-sectional view of a decorative strip according to an eleventh embodiment of the present invention in the fitted state.

FIG. 21 shows a decorative strip 290 according to an eleventh embodiment of the present invention. The decorative strip 290 comprises a decorative strip profile 292 and a holding profile 294.

The decorative strip profile 292 is a strand profile made of metal or plastic, and similarly to the decorative strip profile 262 shown in FIG. 20 comprises a substantially U-shaped cross-section area which is formed by two parallel arms 296 and 298 and a connection arm 300 extending laterally to the latter and connecting the arms 296 and 298 to one another. Here the connection arm 300 encloses with the arms 296 and 298 an angle which is different from 90° so that the decorative surface 302 formed by the connection arm 300 is inclined in the fitted state, as can be seen in FIG. 21. Furthermore, the decorative strip profile 292 comprises an attachment arm 304 attached to the arm 298 and extending perpendicularly to the latter which is provided with openings 306 arranged at regular intervals over the whole length of the decorative strip profile 292.

The holding profile 294 corresponds to the holding profile 14 of the decorative strip 10 according to the first embodiment of the present invention, and so the design of the holding profile 294 will not be discussed again below.

Similarly to the fitting of the decorative strip 290 shown in FIG. 20, in order to cover the ledge 214 of the shower floor 206 shown in FIG. 1, in a first step the holding profile 294 of the decorative strip 290 is fixed to the shower floor 206 along the ledge 214 to be covered by means of tile adhesive. Directly afterwards the tiles 204 are then laid on the arm 30 of the holding profile 294. Next the arm 296 of the decorative strip profile 292 is inserted into the retaining groove 28 of the holding profile 294. The space to be found between the bottom of the retaining groove 28 of the holding profile 294 and the arm 296 of the decorative strip profile 292 can be filled with a filler material, such as for example silicone, tile adhesive or the like. At the same time the attachment arm 298 is fixed to the bathroom floor 200 by means of tile adhesive. In a further step the tiles 204 are laid on the attachment arm 304 of the decorative strip profile 292 along the arm 298 of the decorative strip profile 292.

All of the embodiments described above of the decorative strip according to the invention are characterised by their height-adjustability and can correspondingly be used variably. Moreover, all of the decorative strips which have a wedge-shaped decorative surface can be produced and marketed in excess lengths so that additional height-adjustability, in particular rough height-adjustability, can be achieved by appropriate cutting to length of the decorative strips. The fine height adjustment can then be implemented in the way described in many cases above.

| List of reference numbers | |
|---|---|
| 10 | decorative strip |
| 12 | decorative strip profile |
| 14 | holding profile |
| 16 | decorative surface |
| 18 | dashed line |
| 20 | surface |
| 22 | adhesion structure |
| 24 | arm |
| 26 | arm |
| 28 | retaining groove |
| 30 | arm |
| 32 | opening |
| 33 | insulating strip |
| 34 | filler material |
| 40 | decorative strip |
| 42 | decorative strip profile |
| 44 | holding profile |
| 46 | arm |
| 48 | arm |
| 50 | decorative surface |
| 52 | dashed line |
| 54 | opening |
| 60 | decorative strip |
| 62 | decorative strip profile |
| 64 | holding profile |
| 66 | arm |
| 68 | arm |
| 70 | decorative surface |
| 72 | dashed line |
| 74 | surface |
| 76 | adhesion structure |
| 80 | decorative strip |
| 82 | decorative strip profile |
| 84 | holding profile |
| 86 | arm |
| 88 | arm |
| 90 | arm |
| 92 | decorative surface |
| 94 | dashed line |
| 96 | surface |
| 100 | decorative strip |
| 102 | decorative strip profile |
| 104 | holding profile |
| 106 | attachment arm |
| 108 | openings |
| 120 | decorative strip |
| 122 | decorative strip profile |
| 124 | holding profile |
| 126 | decorative surface |
| 130 | surface |
| 132 | adhesion structure |
| 134 | arm |
| 136 | arm |
| 138 | arm |
| 140 | retaining groove |
| 142 | decorative surface |
| 144 | filler material |
| 150 | decorative strip |
| 152 | decorative strip profile |
| 154 | holding profile |
| 156 | retaining profile |
| 158 | arm |
| 160 | arm |
| 162 | arm |
| 164 | decorative surface |
| 166 | dashed line |
| 168 | surface |
| 170 | adhesion structure |
| 172 | arm |
| 174 | arm |
| 176 | opening |
| 180 | decorative strip |
| 182 | decorative strip profile |

-continued

| List of reference numbers | |
|---|---|
| 184 | holding profile |
| 186 | end profile |
| 188 | arm |
| 190 | arm |
| 192 | arm |
| 196 | decorative surface |
| 198 | adhesion structure |
| 200 | bathroom floor |
| 202 | bathroom wall |
| 204 | tiles |
| 206 | shower floor |
| 208 | floor drain |
| 210 | recess walls |
| 212 | recess walls |
| 214 | ledge |
| 220 | inclined board |
| 222 | sealing strip |
| 230 | decorative strip |
| 232 | decorative strip profile |
| 234 | holding profile |
| 236 | decorative surface |
| 238 | surface |
| 240 | adhesion structure |
| 242 | arm |
| 244 | arm |
| 246 | arm |
| 248 | arm |
| 250 | arm |
| 252 | openings |
| 260 | decorative strip |
| 262 | decorative strip profile |
| 264 | holding profile |
| 266 | retaining profile |
| 268 | arm |
| 270 | arm |
| 272 | connection arm |
| 274 | decorative surface |
| 276 | arm |
| 278 | arm |
| 280 | openings |
| 290 | decorative strip |
| 292 | decorative strip profile |
| 294 | holding profile |
| 296 | arm |
| 298 | arm |
| 300 | connection arm |
| 302 | decorative surface |
| 304 | attachment arm |
| 306 | openings |

The invention claimed is:

1. A walk-in shower floor comprising:

a sloped floor;

a bathroom floor around a periphery of the sloped floor such that the sloped floor forms a wedge-shaped recess within the bathroom floor, the wedge-shaped recess including at least one wedge-shaped recess wall at the periphery of the sloped floor;

a rectangular recess wall running along at least one edge of the sloped floor; and a decorative strip comprising a decorative strip profile and a holding profile, the decorative strip profile having a visible decorative surface;

wherein the decorative strip profile is retained height-adjustably in the holding profile so as to vary a height of the visible decorative surface of the decorative strip profile; and wherein the decorative strip covers at least one of the at least one wedge-shaped recess wall and the rectangular recess wall.

2. The walk-in shower floor according to claim 1, wherein the holding profile has a U-shaped cross-section area for retaining the decorative strip profile, the U-shaped cross-section area being formed in particular like a clamp and/or being provided with an insertion aid for the decorative strip profile.

3. The walk-in shower floor according to claim 1, wherein the decorative surface of the decorative strip profile is rectangular.

4. The walk-in shower floor according to claim 1, wherein the decorative surface of the decorative strip profile tapers like a wedge in the direction of the longitudinal extension of the profile.

5. The walk-in shower floor according to claim 1, wherein the decorative strip profile and/or the holding profile has an attachment arm provided with openings.

6. The walk-in shower floor according to claim 1, wherein the decorative strip profile and/or the holding profile and/or an end profile and/or a retaining profile is/are produced from metal, in particular stainless steel and/or from plastic.

7. The walk-in shower floor according to claim 1, wherein the holding profile has an overall substantially F-shaped cross-section.

8. The walk-in shower floor according to claim 1, wherein the decorative strip profile has an overall substantially I-shaped cross-section.

9. The walk-in shower floor according to claim 1, wherein the decorative strip profile has an overall substantially T-shaped cross-section.

10. The walk-in shower floor according to claim 1, wherein the decorative strip has a third, substantially U-shaped end profile that is retained height-adjustably on the decorative strip profile.

11. The walk-in shower floor according to claim 1, wherein the decorative strip profile has an overall substantially L-shaped cross-section.

12. The walk-in shower floor according to claim 1, wherein the decorative strip profile has a substantially h-shaped cross-section area, the arms of the substantially h-shaped cross-section area disposed parallel to and opposite one another being designed to retain a plate element, in particular to retain a glass or plastic panel.

13. The walk-in shower floor according to claim 12, wherein as an extension of the arm of the substantially h-shaped cross-section area of the decorative strip profile extending laterally to the parallel arms an attachment arm provided with through holes is attached.

14. The walk-in shower floor according to claim 1, wherein the decorative strip profile has an overall substantially U-shaped cross-section with two parallel arms and a connection arm connecting the latter and which extends at an angle to the parallel arms which is different from 90° so that in the fitted state the connection arm forms an inclined surface.

15. The walk-in shower floor according to claim 1, wherein a third retaining profile which is substantially L-shaped when considered as a cross-section and provided with an attachment arm having openings is provided on which the decorative strip profile is retained height-adjustably.

16. The walk-in shower floor according to claim 1, wherein the decorative strip profile and/or the holding profile and/or an end profile and/or a retaining profile is/are produced as a strand part or by the roll forming method or as a flanged profile.

* * * * *